United States Patent [19]

Flink

[11] 4,333,047

[45] Jun. 1, 1982

[54] STARTING CIRCUIT WITH PRECISE TURN-OFF

[75] Inventor: John A. Flink, Oakland, Calif.

[73] Assignee: Precision Monolithics, Inc., Santa Clara, Calif.

[21] Appl. No.: 251,374

[22] Filed: Apr. 6, 1981

[51] Int. Cl.[3] ..... G05F 3/16

[52] U.S. Cl. ..... 323/311; 307/499; 323/901

[58] Field of Search ..... 307/297, 491, 499, 503, 307/571, 581; 323/304, 311, 312, 901

[56] References Cited

U.S. PATENT DOCUMENTS 3,984,761 10/1976 Edington et al. ..... 323/901 X

OTHER PUBLICATIONS

Ronald W. Russell and Thomas M. Frederiksen, "Automotive and Industrial Electronic Building Blocks", IEEE Journal of Solid-State Circuits, vol. SC-7, No. 6, Dec. 1972, pp. 446 to 454.

Adib R. Hamade and Jose F. Albarran, "A JFET/Bipolar Eight-Channel Analog Multiplexer", IEEE Journal of Solid-State Circuits, Dec. 1975, pp. 399 to 406.

Kiyoshi Fukahori, Yukio Nishikawa and Adib R. Hamade, "A High Precision Micropower Operation Amplifier", IEEE Journal of Solid-State Circuits, vol. SC-14, No. 6, Dec. 1979, pp. 1048 to 1058.

U.S. patent application Ser. No. 06/160,674, Filed Jun. 18, 1980, "Powerless Starting Circuit", Yukio Nishikawa.

*Primary Examiner*—A. D. Pellinen

*Attorney, Agent, or Firm*—Richard S. Koppel

[57] ABSTRACT

A current control circuit which can be used to provide starting current during the build-up of an input voltage, and terminate the starting current when the input voltage has reached a predetermined level. The preferred embodiment employs three FETs and one bipolar transistor, located in a total of only two isolation pockets on an integrated circuit chip. The first FET, which is scaled to operate in its saturated region while the second FET is in its resistive region, transmits a current received from the second FET as an output starting current during the initial portion of the input voltage build-up. During this time the second FET holds the gate-source voltage of the first FET to a level less than its pinch-off voltage. The third FET has its gate and source terminals connected in parallel with the first FET, and its drain connected to the base of the bipolar transistor, which is also connected to shunt current away from the first FET when appropriately gated. When the input voltage reaches a predetermined amount, the gate-source voltage of the third FET is elevated to the pinch-off voltage of the first FET, turning that device off. At the same time the bipolar transistor is gated into conduction and shunts the starting current which had previously been transmitted through the first FET.

15 Claims, 7 Drawing Figures

STARTING CIRCUIT WITH PRECISE TURN-OFF

BACKGROUND OF THE INVENTION

1. Field of the Invention

The present invention relates to starting circuits for self-biased linear integrated circuits and, in particular, to starting circuits which draw substantially no power after a voltage supply has reached a desired operating level.

2. Description of the Prior Art

Many analog circuits are designed to be self-biased in order to achieve independence from variations in the supply voltage used to energize the circuit. However, such self-biased circuits often have a stable state in which zero current flows in the circuit even when the power supply voltage is nonzero. This occurs because at the instant the power is applied, the currents in the bipolar transistors in the circuits are in the picoampere range. As is known, the current gain of these transistors at very low current levels is often less than unity. As a result, even with the power supply voltage at a nonzero value, the self-biased circuit is usually unable to drive itself out of the zero-current state. Accordingly, unless precautions are taken, the circuit may remain in this undesired zero-current condition, resulting in the circuitry which it biases also remaining nonfunctional.

To avoid the zero-current conditions, separate starting circuits are commonly used to inject an initial current into the self-biased circuits. Since self-biased circuits with zero-current and nonzero-current operating points have sufficient regenerative or positive feedback to bring the biasing currents to the desired nonzero-current operating point, the initial injection of a relatively small current is sufficient to activate the biasing circuit.

Once the supply voltage has had sufficient time to build up to an operating level and the regenerative action of the self-biased circuit has completed the transistion of the biasing currents to their desired operating levels, the starting circuit is no longer needed. Also, the starting circuit must not interfere with the normal operation of the steady state biasing circuit currents once they have reached their desired operating levels. Accordingly, starting circuits are typically designed to automatically disconnect themselves from the biasing circuit as the desired operating point is reached.

While the starting circuits found in the prior art generally provide sufficient starting current for the biasing circuit and adequately switch themselves out of the circuit once the desired operating point has been reached, they have several limitations. A typical starting circuit of conventional design consists of a series resistor-diode combination connected between the positive and negative voltage supply terminals, with the resistor-diode combination connected to the biasing circuit by another diode. Starting current flows through the connecting diode into the biasing circuit until it is biased off by the current buildup in the bias circuit. Such a resistor-diode circuit, however, even when biased off, results in the resistor dissipating power. This power loss is undesirable, especially in the case of a micropower circuit, in which it may result in a significant degradation of the circuit's performance. Furthermore, the resistors used with this technique are usually fairly large and are implemented in integrated circuit form as an epitaxial resistor or a series of pinch resistors. Because of the large resistance value and high rated breakdown voltage necessary, a large area on the chip must be dedicated to the starting circuitry, even though it is used only when power is first applied.

SUMMARY OF THE INVENTION

In view of the above problems encountered in the prior art, it is an object of the present invention to provide a starting circuit for self-biased linear integrated circuits in which power dissipated by the starting circuit after it has injected the necessary starting current into the self-biased circuit is substantially eliminated.

Another object of the invention is the provision of a starting circuit in which the supply of starting current is precisely terminated in conjunction with the supply voltage building up to a predetermined threshold value.

A further object of the invention is the provision of a starting circuit with no large resistive element or other large geometry devices, thereby reducing the area occupied by the circuit on an integrated circuit die.

Yet another object of the invention is the provision of a relatively inexpensive starting circuit with a small number of components.

Still another object of the invention is the provision of a novel and improved starting circuit which can be easily fabricated in integrated circuit form.

Another object of the invention is the provision of a starting circuit which does not affect the steady-state values of the current in a biasing circuit to which it is connected after an initial starting period.

These and other features of the invention are accomplished in a current control starting circuit having first, second, third and fourth circuit means, the first, second and fourth circuit means preferably being junction field effect transistors (FETs) and the third circuit means preferably being a bipolar transistor. The first circuit means is responsive to a control voltage differential to transmit an output current from the starting circuit when the control voltage differential is less than a predetermined turnoff voltage, and to substantially terminate the output current when the control voltage differential exceeds the turnoff voltage. A second circuit means is connected to deliver a controlled level of current for transmission by the first circuit means as the starting current, and is responsive to the input voltage being less than a predetermined threshold level to establish a control voltage differential for the first circuit means at a level less than the predetermined turnoff voltage. The third circuit means has a control terminal and is connected to shunt current from the second current means away from the first circuit means, and thereby substantially terminate the transmission of starting current by the first circuit means, in response to a gating voltage signal at its control terminal. The fourth circuit means reponds to the input voltage exceeding the first threshold level by establishing a control voltage differential for the first circuit means which is substantially at least equal to the predetermined turnoff voltage, and also by establishing a gating voltage at the control terminal for the third circuit means to cause the third circuit means to shunt current away from the first circuit means.

In accordance with the above circuit, the controlled current delivered by the second circuit means is transmitted by the first circuit means and appears as a starting current output when the input voltage is less than the threshold level. When the input voltage exceeds the threshold level the first circuit means is turned off and the controlled current from the second circuit means is shunted away by the third circuit means, thereby terminating the provision of output starting current.

In a preferred embodiment of the invention, the first, second and fourth circuit means comprise first, second and third junction FETs, and the third circuit means comprises a bipolar transistor. The gates of all of the FETs are connected together to a supply voltage bus, as is the source of the second FET. The sources of the first and third FETs are connected together to the drain of the second FET so that the gate-source terminals of the first and third FETs are in parallel. The drain of the first FET provides the output starting current of the circuit, while the drain of the third FET is connected to the base of the bipolar transistor, thereby restraining the current through the third FET to a level well below its full scale current. The collector-emitter circuit of the bipolar transistor provides a path between the drain of the second FET and a current sink.

In operation, the gate-source voltage of the third FET, under the current restraint imposed by its drain connection to the base of the bipolar transistor, build up to a pinch-off voltage level as the supply voltage builds up to its full amount. At the same time, its drain voltage builds up to a level which gates the bipolar transistor into conduction. As a result the first FET is pinched-off and ceases to conduct starting current from the second FET at substantially the same time that the bipolar transistor is gated into conduction and begins to shunt the current from the second FET. A precise turn-off of starting current is thereby accomplished with only a small number of circuit components occupying a small area on a circuit chip.

DESCRIPTION OF THE DRAWINGS

These and other objects and advantages of the present invention will be apparent to those skilled in the art from the ensuing detailed description, taken together with the accompanying drawings, in which.

DETAILED DESCRIPTION OF PREFERRED EMBODIMENTS

Figure 1:
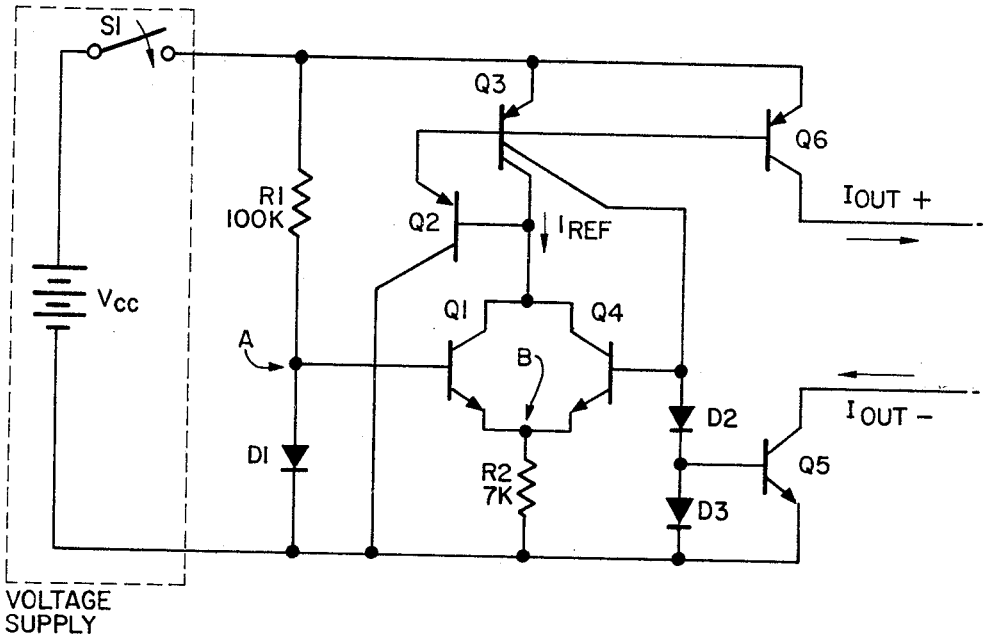
FIG. 1. (PRIOR ART)
FIGS. 1 and 2 are schematic diagrams of two prior art starting circuits.
Figure 2:
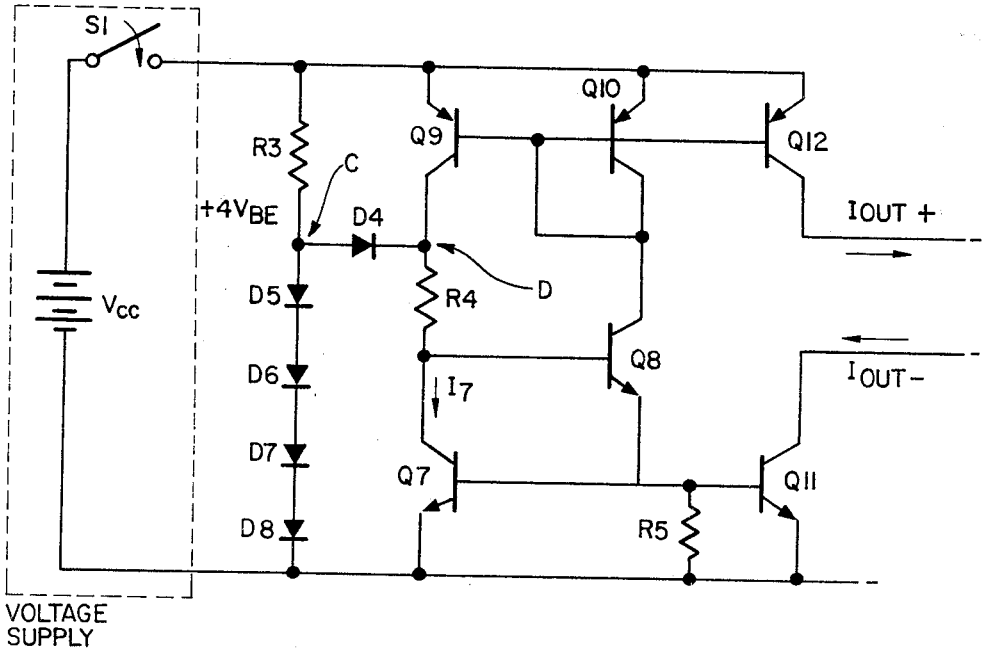
FIG. 2. (PRIOR ART)

Referring to the drawings, FIGS. 1 and 2 show two prior art versions of starting circuits for self-biased circuits of the type which are connected to a voltage supply, and have biasing currents which are stable at two operating points at which the biasing currents are either zero or nonzero in value when the supply voltage is nonzero. In FIGS. 1 and 2 the voltage supply has been shown diagrammatically as a battery of voltage $V_{CC}$ connected to an open switch S1 which is about to close. It is to be understood that this configuration is merely representative of the electronic power supplies used to energize the circuitry.

FIG. 1 is typical of a variety of prior art starting circuits used widely in the semiconductor industry. The starting circuit of FIG. 1 comprises resistor R1, diode D1, and transistor Q1. The remainder of the circuitry in FIG. 1 comprises a bias regulator circuit which provides biasing currents $I_{OUT+}$ and $I_{OUT-}$ for additional circuitry which is not shown. The bias circuitry in FIG. 1 is designed to be independent of fluctuations in the supply voltage $V_{CC}$ once the proper operating currents have been established. When the proper operating currents are established the voltage across resistor R2, which is connected between the emitter of Q1 and the negative battery terminal, is approximately one forward diode voltage drop. This establishes a reference current $I_{REF}$ which is independent of $V_{CC}$, thereby providing the circuit with its self-biasing characteristic.

Without the starting curcuit R1, D1 and Q1, however, the initial application of voltage by the closure of switch S1 would not necessarily establish the proper operating currents for the biased circuit. This is because circuits of the type shown in FIGS. 1 and 2 have a stable operating point in which zero current flows in the circuit even when the supply voltage is nonzero. This condition occurs because the currents in the transistors are very small, often in the picoampere range, when the supply voltage is first applied. Furthermore, as the current gain of the transistors at very low currents is often less than unity, the circuit is usually unable to drive itself out of the zero current state. Therefore, without the starting circuit, the circuit would continue to be in the undesired zerocurrent state.

The starting circuit of FIG. 1 composed of resistor R1, diode D1, and transistor Q1 injects an initial starting current to enable the biasing circuit to begin operating, thereby preventing the transistor gains from falling to less than unity values. Furthermore, after injecting this current, the starting circuit of FIG. 1 disconnects itself from the biasing circuitry so as not to interfere with its normal operation once it has reached the desired operating point.

The operation of the circuit shown in FIG. 1 will now briefly be explained. When power is first applied to the starting circuit, the current through resistor R1 turns transistor Q1 on. In turn, Q1 forces current to be mirrored through transistors Q2 and Q3 to diodes D2 and D3, thereby turning on transistor Q4, the collector and emitter of which are connected in parallel with Q1. When the steady state is reached the emitter of Q1, at node B, which is also connected to resistor R2, is biased at one $V_{BE}$ (approximately equal to one forward-biased diode drop). Similarly, the base of transistor Q1, at node A, is biased at one $V_{BE}$ by diode D1. Accordingly transistor Q1 is off. Since transistor Q1 is off, the starting circuit is effectively disconnected from the activated bias circuit. Accordingly, the initial injection of current via R1 and Q1 into Q2 starts a regenerative process by which Q4 is turned on and Q1 is turned off. As a result, the positive feedback present in the circuit of FIG. 1 only requires the injection of a very small current by resistor R1 and transistor Q1 to allow the circuit to bring itself to its proper operating point.

FIG. 2 showns another prior art version of a starting circuit connected to a biasing circuit. In FIG. 2 the starting circuit is composed of resistor R3 and diodes D4, D5, D6, D7 and D8. The operation of the starting circuit can be explained by assuming the circuit of FIG. 2 to be initially in the undesired zero-current state. In this state, the voltage at the base of transistor Q7 is at ground potential. The voltage at the base of transistor Q8 is in the order of tens of millivolts above ground, as determined by the leakage currents in the circuit. However, the voltage at node C between R3, D4 and D5 is four diode drops above ground ($+4V_{BE}$), so that a voltage of approximately three diode drops appears across resistor R4 and a current flows through resistor R4 into the Q7–Q8 transistor configuration. This causes currents to flow in transistors Q9 and Q10, avoiding the zero-current state.

After the bias circuit drives itself to the desired stable state, the starting circuit must not effect the steady-state current values. In FIG. 2, this is accomplished by causing resistor R4 to be large enough so that when the steady-state current is established through Q7, the voltage drop across R4 is large enough to reverse-bias diode D4. In the steady-state, therefore, the voltage at node D (between D4, Q9 and R4) is two diode drops plus $I_{C7} \cdot R4$ above ground and the voltage at node C is four diode drops above ground. Thus, by making $I_{C7} \cdot R4$ equal to two diode drops, D4 will have zero voltage across it in the steady state, thereby disconnecting the starting circuit from the biasing circuit.

The prior art circuits shown in FIGS. 1 and 2 have two primary disadvantages. First, resistors R1 in FIG. 1 and R3 in FIG. 2 must have relatively large values, on the order of 100K ohms. As such resistors are typically implemented on an integrated circuit die as an epitaxial resistor, a series of pinch resistors, or a high-value base resistor, they usually occupy large areas on the chip. Furthermore, even when the starting circuit is disconnected from the bias circuit these resistors continue to dissipate power, which especially hurts the performance of micropower circuits which require a starting circuit. These disadvantages are overcome by the present invention which eliminates resistors in the starting circuit and uses a purely transistor circuit to initiate and control the starting current. The starting current is injected by an FET which is automatically switched off, and the starting current shunted away from it, when the voltage supplied to the starting circuit has built up to its full value.

In order to understand the operation and advantages of the present invention, it will be helpful to briefly review the basic nature of an FET. Because it is a unipolar device, an FET is normally in the "on" state until its channel is pinched off by a reverse gate-to-source voltage of sufficient strength to remove all of the free charge from the channel and in effect turn the FET off (the "pinch-off voltage" $V_P$). When in the "on" state, the FET resistance can be in the 100-ohm range, while its "off" resistance can be in the 100-megohm range. Thus, the FET has a low "on" resistance until it is biased "off", whereupon it assumes a very high resistance. By contrast, a bipolar transistor is a normally "off" device which must be biased "on". Thus, if an all bipolar approach is taken in a starting circuit, a direct path between the positive and negative voltage supplies is normally needed to provide the starting current. This in turn requires the use of large-value resistors, which consume power and occupy large areas.

Figure 3:
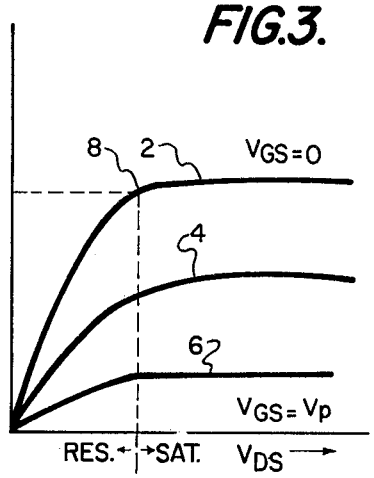
FIG. 3 is a graph showing current and voltage relationships for a typical FET.

Referring now to FIG. 3, a typical voltage-current characteristic for an FET is shown. Drain-source current ($I_{DS}$) is plotted along the vertical axis and drain-source voltage ($V_{DS}$) along the horizontal axis. For a gate-source voltage ($V_{GS}$) of zero volts, the resulting voltage-current relationship is as shown in curve 2. On this curve $I_{DS}$ progressively increases with $V_{DS}$ until reaching a maximum value $I_{DSS}$, after which it remains at substantially the same maximum current value as $V_{DS}$ increases further. For a larger $V_{GS}$, $I_{DS}$ increases at a slower rate with increasing $V_{DS}$, as illustrated in curve 4, and reaches a maximum value at a current level less than $I_{DSS}$. When $V_{GS}$ is increased further, the result is illustrated in curve 6; $I_{DS}$ increases even more slowly with $V_{DS}$, reaching a maximum value at an even lower current level. The current response to $V_{DS}$ continues to attenuate as $V_{GS}$ increases, finally reaching a substantially zero response along the horizontal axis when $V_{GS}$ equals $V_P$, typically at about 2 volts.

Since the current responds approximately proportionately to $V_{DS}$ to the left of the "knee" 8 of the current-voltage curves of FIG. 3, this region is denoted the resistive region of FET operation. To the right of the knee, where the current is substantially nonresponsive to increases in $V_{DS}$, the FETs are operating in their saturated regions.

Figure 4:
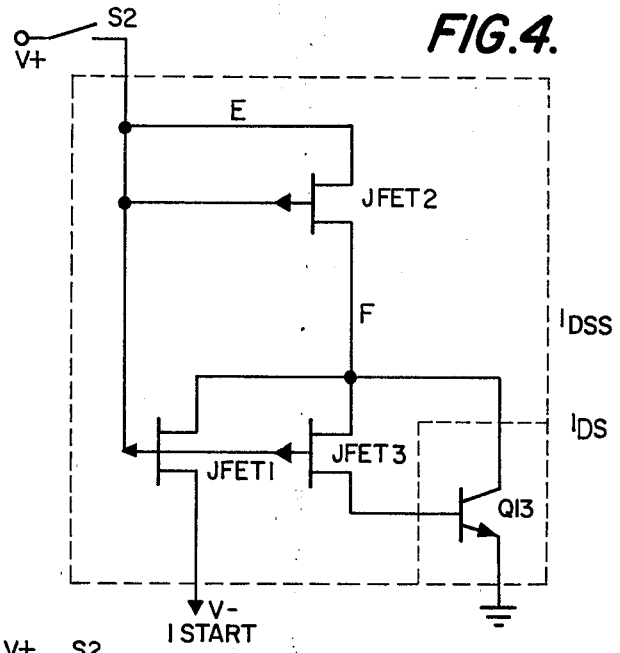
FIG. 4 is a schematic diagram of one embodiment of the invention, using P channel FETs.

A first embodiment of the present invention which employs an FET network to generate a starting current is shown in FIG. 4. In this circuit the FETs are provided in the form of P-channel junction FETs (JFET). Alternatively, the FETs could be N-channel JFETs, P-channel MOSFETs, or N-channel MOSFETs. The JFETs may be of the epitaxial, diffused or implanted variety. Similarly, the MOSFETs may utilize any of the common constructions such as MIS, silicon gate, etc.

The circuit shown in FIG. 4 is a very simple starting circuit which can be used in conjunction with a wide variety of self-biased circuits, such as regenerative peaking sources; regenerative "back-to-back" current source; micropower circuits; preset circuits for flip-flops; preset circuits for oscillators; start circuits for voltage references and regulators; circuits for measuring $V_P$ for bifet products; and power-on or event indicators using an SCR as a switch.

The circuit of FIG. 4 consists of a first circuit means comprising JFET1, a second circuit means comprising JFET2, a third circuit means comprising bipolar transistor Q13, and a fourth circuit means comprising JFET3. The gates of JFETs 1, 2 and 3 are all connected together, thereby facilitating a very simple arrangement on an integrated circuit chip in which all three JFETs are located within a single isolation pocket, indicated in the drawing by a dashed-line box. In the embodiment shown it is desirable that JFETs 1 and 3 be closely matched, in order to coordinate their pinch-off voltages as explained further below, and to this end the two JFETs may be formed from a single gate and source, with a separate drain for each device.

The gates of all three JFETs as well as the source of JFET2 are connected to a positive voltage bus denoted by node E, and then through switch S2 to a source of positive voltage V+. The drain of JFET2, the sources of JFETs 1 and 3, and the collector of Q13 are all connected together at node F. The base of Q13 is connected to the drain of JFET3, and its emitter is grounded. Output starting current is provided from the drain of JFET1.

The circuit consisting of JFET2, JFET3 and Q13 has been used in the prior art to generate a pinch-off voltage, and is disclosed in an article by Adib R. Hamade and Jose F. Albarran, "A JFET/Bipolar 8-channel Analog Multiplexer", *IEEE Journal of Solid-State Circuits*, December 1975, pages 399–406. In the present invention, it is utilized to generate a pinch-off voltage for JFET1 which precisely terminates the starting current through that element when the voltage at node E has built up to a predetermined threshold level after switch S2 has closed.

To illustrate the operation of the starting circuit, assume first that switch S2 is open and no voltage is applied at node E. In this condition each of the JFETs is "on", while Q13 is "off". When S2 is closed, voltage begins to build up at node E, causing a current to flow through JFET2 in its resistive region of operation. Since Q13 is "off" and the drain current of JFET3 is restrained by its connection to the base of Q13, substantially all of the current through JFET2 will be transmitted by JFET1 as starting current.

The drain of JFET1 is preferably connected to a negative voltage bus V− of sufficient voltage to cause the device to operate in its saturated region during this initial portion of the positive voltage buildup. Since the source-drain voltage drop across JFET2 is relatively small during this period, the parallel connection between the source and drain of JFET2 and the source and gate of JFET1 establishes a control voltage differential which keeps $V_{GS}$ of JFET1 at less than $V_P$. $V_{GS}$ for JFET1 will thus be small, and the current through JFET1 will be approximately equal to $I_{DSS}$ for that device. JFET1 is selected such that its $I_{DSS}$ is equal to the desired level of starting current. JFET2, which is scaled larger than JFET1 and accordingly is capable of transmitting a larger current, is operating in its resistive region during this period.

When the input, or positive supply, voltage at node E has built up to a level slightly greater than the turn-on voltage ($V_{BE}$) for Q13, typically in the order of 0.6 or 0.7 volts, current begins to flow into JFET3 and Q13. $V_{DS}$ for JFET2 and JFET3 is small compared to $V_{BE}$, so that the base of Q13 reaches $V_{BE}$ shortly after the supply voltage has reached that level. While current has begun to flow through JFET3 at this point, it remains essentially "off", since its current is limited to the collector current of Q13 divided by $\beta$ of Q13, which yields a resulting current substantially less than $I_{DSS}$ of JFET3. JFET1 remains "on" at its $I_{DSS}$ level, while Q13 conducts the surplus current from JFET2.

JFET1 continues to transmit full scale starting current until the positive supply voltage has built up to a predetermined threshold level slightly greater than $V_P+V_{BE}$. The exact value of the threshold level will depend upon the particular construction of the various circuit elements. Beyond the threshold level JFET2 is scaled to enter its saturation region, and commences functioning as a current source. Also at this time the base voltage of Q13 has built up to approximately $V_{BE}$, gating that transistor into full conduction. Because of the drain connection of JFET3 to the base of Q13, however, $I_{DS3}$ remains at a very low level, essentially off. Under these conditions, it can be shown that $V_{GS3}$ will be approximately equal to $V_P$. Specifically, the equation relating $I_{DS3}$ to $V_{GS3}$ in the saturated region is:

$$I_{DS3} = I_{DSS3}\left[1 - \frac{V_{GS3}}{V_P}\right]^2$$

With $I_{DS3}$ negligibly small compared to $I_{DSS3}$, $V_{GS3}$ is approximately equal to $V_P$. Since the gates and sources of JFET3 and JFET1 are connected in parallel, the voltage differential $V_{GS1}$ will also be approximately equal to $V_P$, essentially turning JFET1 "off" with only a small remaining drain current. Substantially all of the current from JFET2 is now shunted through Q13, and the starting current from JFET1 is precisely turned off.

The input voltage at which turnoff occurs can be controlled by constructing the circuit components such that the turnoff input voltage level $V_P+V_{BE}$ corresponds to a desired threshold level for terminating starting current. The starting current magnitude can also be readily controlled by an appropriate selection of the channel dimensions for JFET1. The starting current, which is equal to $I_{DSS1}$, is directly proportional to the channel width of JFET1 and inversely proportional to its effective channel length; a desired level of starting current may be obtained by selecting these dimensions in a fashion compatible with the desired area to be occupied by the device.

Figure 5:
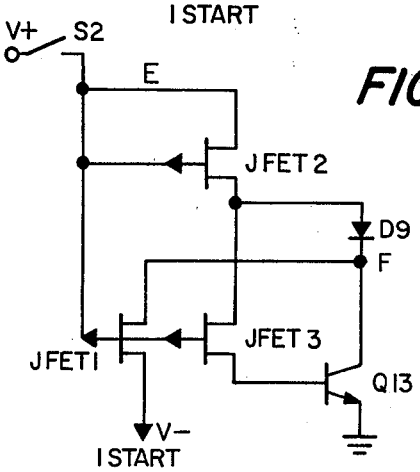
FIG. 5 is a schematic diagram of another embodiment of the invention.

Referring now to FIG. 5, a modified embodiment of the invention is shown which helps to insure that JFET1 turns off, even without close matching between JFET1 and JFET3 with respect to $V_P$. In this Fig. the same reference numerals are used for elements that are common to the circuit of FIG. 4. The modification involves the addition of a diode D9 between the drain of JFET2 and node F, and the rerouting of the source of JFET3 from its connection with node F to connection directly with the the drain of JFET2, bypassing node F. The addition of D9 increases $V_{GS1}$ to $V_P+V_{BE}$ at the time $V_{GS3}$ reaches $V_P$, thus ensuring that the starting current transmitted by JFET1 is truly off by the time the voltage at the input terminal has reached its threshold level, despite variations in $V_P$ matching. In this configuration D9 is not connected in the source circuit for JFET3, or that component would go absolutely off and not supply the small amount of base current necessary to gate Q13.

In the embodiment of FIG. 5 the starting current transmitted by JFET1 is reduced by a factor of 2 as compared with the starting current for the circuit of FIG. 4. In order to maintain the same starting current level, the channel width/length ratio for JFET1 in FIG. 5 may be doubled.

Figure 6:
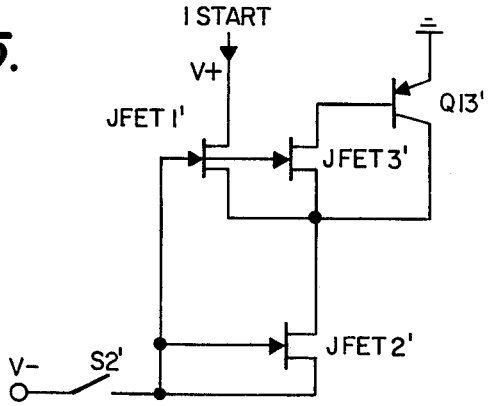
FIG. 6 is a schematic diagram of a third embodiment of the invention, using N channel FETs.

The embodiments considered thus far have employed P-channel JFETs. As illustrated in FIG. 6, the invention can also be implemented with N-channel JFETs. The circuit shown is complimentary to the one illustrated in FIG. 4, with a negative voltage applied through a switch S2′, and starting current flowing from a device JFET1′ whose gate-source voltage is controlled by JFET3′.

Figure 7:
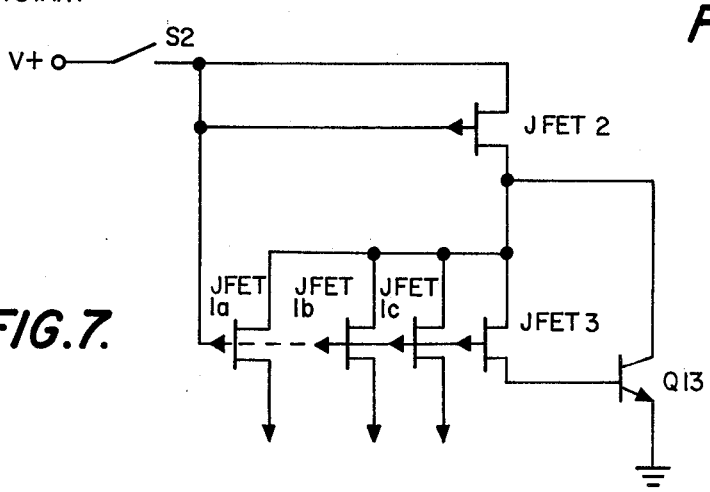
FIG. 7 is a schematic diagram of a multiple output embodiment of the invention.

Referring now to FIG. 7, another embodiment is shown in which the invention is implemented as a multiple start circuit. While the remainder of the circuitry is similar to that shown in FIG. 4, JFET1 is replaced by a plurality of separate devices JFET1a, JFET1b and JFET1c. Each of these devices has its gate and source connected in parallel with JFET3, and provides a respective starting current through its drain. The various starting current can be proportioned with respect to each by selecting appropriate channel width/length ratios for their respective JFETs. Each of these starting current JFETs is designed to turn-off when its respective $V_{GS}$ equals or exceeds the same $V_P$.

A very simple circuit, using only four transistors and two isolation pockets to generate a starting current, and which is inherently "on" until a predetermined threshold voltage has been built up at an input terminal, has thus been shown and described. While various modifications will occur to those skilled in the art, it is intended that the invention be limited only in terms of the appended claims.

I claim:

1. A current control circuit for producing an output current when an input voltage is less than a predetermined threshold level, and substantially terminating the output current when the input voltage exceeds said threshold level, comprising:

a first circuit means responsive to a control voltage differential to transmit an output current when the control voltage differential is less than a predetermined turnoff voltage, and to substantially terminate the output current when the control voltage differential exceeds said turnoff voltage, said first circuit means comprising an FET having a gate, source and drain, a second circuit means connected to deliver a current for transmission by said first circuit means, said second circuit means being responsive to said input voltage to establish a control voltage differential for said first circuit means at a level less than the turnoff voltage when said input voltage is less than said threshold level, a third circuit means having a control terminal and being connected to shunt current from said second circuit means away from the first circuit means, and thereby substantially terminate the transmission of output current by the first circuit means in response to a gating voltage at said control terminal, and a fourth circuit means connected in circuit with said first, second and third circuit means and responsive to said input voltage exceeding said threshold level to establish (a) a control voltage differential for said first circuit means substantially at least equal to the turnoff voltage, and (b) a voltage at the control terminal for said third circuit means sufficient to cause said third circuit means to shunt current away from the first circuit means, said fourth circuit means comprising an FET having a gate, source and drain, the gates of the first and fourth circuit means being connected together, and the sources of the first and fourth circuit means being connected together to receive the current from the second circuit means, whereby the current delivered by said second circuit means is transmitted by the first circuit means as an output current of the current control circuit when the input voltage is less than the threshold level, but is shunted away from the first circuit means by the third circuit means when the input voltage exceeds the threshold level.

2. The current control circuit of claim 1, wherein said third circuit means comprises a bipolar transistor having an emitter, collector and base, its base being connected to the drain of the FET comprising the fourth circuit means, and its emitter-collector circuit connected to shunt the current from the second circuit means away from the FET comprising the first circuit means when a gating signal is applied to its base.

3. The current control circuit of claims 1 or 2, wherein the drain of the FET comprising the fourth circuit means is connected to provide the control voltage for the third circuit means, said third circuit means when shunting current away from the first circuit means also functioning to limit the drain current of the FET comprising the fourth circuit means to a low level at which the gate-source voltage of said FET, and accordingly the gate-source voltage of the FET comprising the first circuit means, is established at substantially the pinch-off voltage.

4. The current control circuit of claim 3, including means for maintaining the drain voltage of the FET comprising the first circuit means at a greater differential from its source voltage than is the drain voltage of the FET comprising the fourth circuit means, thereby enabling a full scale current to flow through the former FET when the input voltage is less than said threshold level, while the current through the latter FET is less than full scale.

5. The current control circuit of claim 1, wherein said second circuit means comprises an FET having a gate, source and drain and is connected to operate in its resistive region when the input voltage is less than said threshold level.

6. The current control circuit of claim 5, wherein the gate and source of the FET comprising the second circuit means are connected in common to receive the input voltage.

7. The current control circuit of claim 6, wherein the gates of the FETs comprising the first, second and fourth circuit means are all connected in common.

8. The current control circuit of claim 7, provided as an integrated circuit within a plurality of isolation pockets, wherein the FETs comprising the first, second and fourth circuit means share a common gate and are all located within a common isolation pocket.

9. The current control circuit of claim 1, wherein said second circuit means comprises an FET having a gate, source and drain, the FET comprising said second circuit means being scaled larger than the FET comprising the first circuit means whereby the latter FET receives and transmits a full scale current while the former FET is operating in its resistive region.

10. The current control circuit of claims 1 or 9, wherein the FET comprising the second circuit means is connected to operate in its saturated region when the input voltage exceeds said threshold level.

11. A starting current circuit for providing starting current during the buildup of an input voltage, and for substantially turning off the starting current when the input voltage reaches a predetermined threshold level, comprising:

an input voltage bus, first, second and third FETs having respective gates, sources and drains, the first FET having its gate connected to the input voltage bus, its source connected to receive current from the second FET, and its drain connected to deliver a starting current, the second FET having its gate and source connected to the input voltage bus, and its drain connected to the source of the first FET, the third FET having its gate and source connected in parallel with the gate and source of the first FET, and a bipolar transistor having a base, collector and emitter, its collector-emitter circuit being connected to shunt current from the drain of the second FET away from the first FET, and its base connected to the drain of the third FET, the second FET providing starting current to the first FET when the input voltage is less than the threshold level, the third FET providing base current to gate the bipolar transistor into conduction and thereby shunt the second FET current away from the first FET when the input voltage exceeds the threshold level, the level of base current demanded by the transistor limiting the drain current of the third FET to a level substantially corresponding to a pinch-off voltage is also applied across the gate and source of the first FET to substantially terminate its current output when the input voltage exceeds the threshold level.

12. The starting current circuit of claim 11, wherein the second FET is scaled to carry a greater full scale current than the first FET, thereby enabling the first FET to deliver a substantially full scale current output while the second FET is operating in its resistive region.

13. The starting current circuit of claim 11, provided as an integrated circuit within a plurality of isolation pockets, wherein the first, second and third FETs each share a common gate and are located within a common isolation pocket.

14. The starting current circuit of claim 11, further comprising means maintaining the voltage at the drain of the first FET at a greater differential from the voltage at the source of that FET than the drain-source voltage of the third FET, and thereby enabling a full scale current to flow through the first FET when the input voltage is less than its threshold level, while the current through the third FET is less than full scale.

15. The starting current circuit of claim 11, adapted to provide a plurality of starting currents, wherein at least one additional FET similar to the first FET is provided, each additional FET having its gate and source connected in common respectively with the gate and source of the first FET, and providing an output current from its drain, whereby the first and each additional FET provide respective starting currents.

* * * * *